US005092832A

United States Patent [19]

Crowley

[11] Patent Number: 5,092,832

[45] Date of Patent: Mar. 3, 1992

[54] METHOD AND APPARATUS FOR CREASING CONTINUOUS WEB

[75] Inventor: H. W. Crowley, Newton, Mass.

[73] Assignee: Roll Systems, Inc., Burlington, Mass.

[21] Appl. No.: 536,209

[22] Filed: Jun. 11, 1990

[51] Int. Cl.[5] ..... B31F 1/00; B31F 7/00

[52] U.S. Cl. ..... 493/421; 493/419; 493/14; 493/18; 493/23

[58] Field of Search ..... 493/3, 8, 10, 12, 13, 493/14, 15, 17, 18, 23, 24, 25, 27, 29, 419, 420, 421, 436, 433

[56] References Cited

U.S. PATENT DOCUMENTS

| | | | |
|---|---|---|---|
| 1,716,936 | 6/1929 | Waterworth | 493/421 |
| 1,770,312 | 7/1930 | Kleinschmit | 493/419 |
| 1,831,250 | 11/1931 | Ibell | 493/419 |
| 1,848,448 | 3/1932 | Weidner | 493/421 |
| 3,416,785 | 12/1968 | Sherman | 493/420 X |
| 3,698,705 | 10/1972 | Funk et al. | 493/25 X |
| 3,712,610 | 1/1973 | Garrone | 493/10 |
| 3,729,186 | 4/1973 | Macke | 493/360 X |
| 3,747,917 | 7/1973 | Roda | 493/14 X |
| 3,975,009 | 8/1976 | Brown | 493/14 |
| 4,125,254 | 11/1978 | Boyer | 493/8 |
| 4,234,179 | 11/1980 | Weir | 493/14 |
| 4,504,259 | 3/1985 | Lindenmüller | 493/23 |
| 4,573,671 | 3/1986 | Reponty | 270/20.1 |
| 4,699,606 | 10/1987 | Whitley, Jr. et al. | 493/24 X |
| 4,701,155 | 10/1987 | Ott | 493/14 |

FOREIGN PATENT DOCUMENTS

| | | | |
|---|---|---|---|
| 1214247 | 4/1966 | Fed. Rep. of Germany | 493/421 |
| 3417420 | 12/1984 | Fed. Rep. of Germany | 493/3 |
| 0052469 | 3/1985 | Japan | 493/421 |
| 0002668 | 1/1986 | Japan | 493/421 |

OTHER PUBLICATIONS

"Paper Handling Roller", International Technology Disclosures, vol. 3, No. 6, 25 Jun. 1985.

*Primary Examiner*—Bruce M. Kisliuk
*Assistant Examiner*—John A. Marlott
*Attorney, Agent, or Firm*—Wolf, Greenfield & Sacks

[57] ABSTRACT

A system and method for creasing continuous web at predetermined locations. A continuous web material is biased in the first direction. The web is then pinched in a second direction. This pinching is accomplished by drawing a bend in the web into the pinching element, and, following the pinching, the web including a crease is driven out of the pinching element. This section of web containing a crease is then output from the system. A second pinching may also be performed subsequent to the first pinching. This second pinching would occur on the opposite face of the web at a further point along the web. This would result in a zig-zag pattern of creases.

30 Claims, 4 Drawing Sheets

METHOD AND APPARATUS FOR CREASING CONTINUOUS WEB

BACKGROUND OF THE INVENTION

1. Field of the Invention

This invention relates to a system and method for creasing a continuous web of material and, more particularly, to a system and method of creasing a web on either face at predetermined points along each face in a continuous motion.

2. Background of the Invention

It is often desirable that a continuous web of paper or other material be folded into a manageable stack, often using a zig-zag pattern of folding. In order to accomplish this folding, the web must first be creased at various predetermined points to allow the web to bend over into place. Additionally, many other functions may be served by creasing a web at various points. Previous creasing devices have generally incorporated therein a folding function, such that the structure of the creaser has not permitted versatile and variable location of creases along the length of the web material. The result of the combination of two functions has been a rather complex creasing device and refolder with limited versatility in relation to the lengths and sides of a web upon which creases may be made. Many creasing devices also contain the additional disadvantage of requiring specialized pre-formed feed holes and surface perforations to accurately locate creases on the web.

SUMMARY OF THE INVENTION

It is, therefore, an object of the present invention to produce creases on either face of a continuous web material with significantly increased speed.

It is a further object of this invention to provide a system that allows increased versatility in the creasing of faces and locations along the continuous web material.

It is a further object of this invention to provide a system for creasing a continuous web material that is separate from any folding process.

It is a further object of this invention to provide a system that can detect jams and other errors in the creasing process.

It is a further object of this invention to provide a system with the capability of creasing a web without need for either feed holes or other perforations to accomplish web advance or crease location.

This invention results from the understanding that a truly effective system for creasing a continuous web can be achieved by driving the web to cause a natural bend at a point and drawing in and pinching this natural bend to form a crease that is subsequently drawn out of the creasing system To accomplish the foregoing and other objects of this invention, there is provided, in accordance with one aspect thereof, a system for creasing a continuous web of material comprising means for biasing the continuous web in a first direction. There is provided at least a first means for pinching a crease in the web that is disposed in a second direction. This first means for pinching includes first means for drawing a bend in the web into the first means for pinching and also includes a first means for driving out the web with a crease from the first means for pinching. There is further provided means for outputting a section of the web containing a crease from the system. In the embodiment described herein, the system may further comprise a second means for pinching a crease in the web that is disposed in a third direction relative to the opposite face of the web from the face that is relative to the first means for pinching. The second means for pinching may include second means for drawing a bend in the web into the second means for pinching and also may include second means for driving out a creased web from the second means for pinching. According to this embodiment, the system may provide a first means for drawing that operates simultaneously with the second means for driving out and a second means for drawing that operates simultaneously with the first means for driving out. This simultaneous operation may result in a first means for driving out that allows the formation of a bend in the web that is drawn in by the second means for pinching by the second means for drawing, and similarly, the second means for driving out may allow formation of a bend that is drawn into the first means for pinching by the first means for drawing. The first and second means for pinching may each include a corresponding pair of selectively rotatable roller means that are spaced in parallel at a predetermined distance. The first and second means for drawing may include a means for rotating these selectively rotatable roller means to allow a bend in the web to be forcibly driven between the roller means. Furthermore, the first and second means for driving out may include means for motioning these roller means to allow a creased web to be forcibly driven out from between the roller means. The roller means themselves may include a frictional surface to allow increased adhesion of the web to the surface, thus, expediting the drawing in of a bend in the web and also the movement of the creased web into and out of the pinching means. The preferred embodiment of this system may also comprise means for pinching that each include guide means to direct each side of the creased web as it moves into and out of the means for pinching. These guide means may be constructed from a pair of spaced plate mean between which the creased web passes. The guide means may include, located thereon at a point, jam detection means for detecting the presence of the creased web at such a predetermined time that any detection of the web would indicate a jam condition. The guide means may also include means for slowing the further advance of the creased web along the guide. This means for slowing may itself include a slow detection means disposed on the guide at a point where the further advance of the web is predetermined to be desirably at a slower rate. Additionally, the guide means may also include, located thereon, a means for reversing the direction of movement of the creased web to allow the creased web to be driven out of the means for pinching. This means for reversing may itself include a reverse detection means disposed on the guide means at a point such that it is relative to the predetermined distance between creases on the web. In accordance with this invention, the means for biasing may comprise a pair of selectively rotating input roller means between which the web is driven and the means for outputting may comprise a pair of selectively rotating output roller means between which the creased web is driven. This pair of output roller means may itself include a means for applying a predetermined maximum amount of torque with rotational slippage, to remove slack from the creased web exiting the means for pinching while, at the same time, preventing any breakage of the creased web. This web may be a paper material.

In accordance with another aspect of the present invention, there is provided a method for creasing a continuous web at predetermined locations comprising the steps of biasing a continuous web in a first direction. The next step is to perform at least one pinching of a crease in the web which includes the steps of performing a first drawing of a bend in the web into the first pinching step and, subsequently, a first driving out of the web including a crease from the first pinching step. The final step is to output a section of web containing the crease from the system. In a preferred embodiment, this method for creasing may further include the step of a second pinching of a crease in the web to occur in a third direction relative to the opposite face of the web from the face relative to the first pinching step. This second pinching step includes second drawing and second driving out steps similar to those for the first pinching step. Finally, the first drawing and second driving out, as well as the second drawing and first driving out, may respectively occur simultaneously allowing continuous operation.

BRIEF DESCRIPTION OF THE DRAWINGS

Other objects, features and advantages will occur to those skilled in the art from the following description of the preferred embodiment and the accompanying drawings in which.

DETAILED DESCRIPTION

Figure 1:
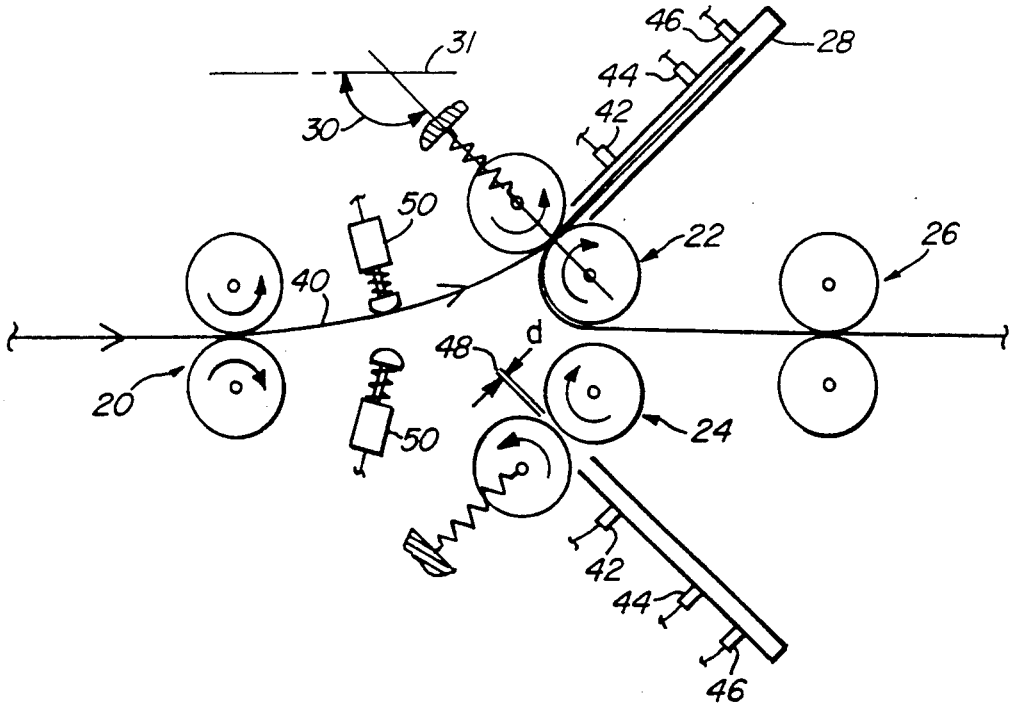
FIG. 1 is a schematic diagram of the operational elements of a creasing system according to this invention.

The act of creasing a web of paper generally involves the bending of the paper and pinching along a predetermined location on the bend. This process may be performed mechanically. However, in order to allow a continuously and quickly flowing input of material to be effectively processed, a method of pinching capable of operating under conditions of continuous movement is necessary. Therefore, the preferred embodiment of this invention outlined at FIG. 1 discloses a creasing system consisting of a pair of rollers 20 for driving the input of the web material into the system. These rollers may be driven at a constant speed for continuous input. An upper 22 or lower 24 pair of pinching rollers catch a bend in the web and draw it inward between the pair.

This bend exists in the web for the rollers to catch the web. As described further below, bends are formed upon opposite sides of the web as a result of the ongoing action of opposing pairs of rollers. However, an initial bend, to begin the process, may be formed by applying opposing forces briefly to both ends of the web to cause it to buckle at the pinching roller location. For example, the roller pairs 20 and 26 may be operated at different speeds to cause a web bunching (bend). Once this first bend has occurred, subsequent bends arise by the action of the system.

With each action of the rollers, a crease is pinched upon the surface of the web. These rollers are positioned at an angle 30 relative to the input plane 31 with which the input web is parallel. This angle relates closely to the natural bend of the web. Following the pinching operation, the material is driven out of the system by a pair of output rollers 26. These rollers 26 maintain a constant torque on the web sufficient to maintain a desired level of tautness on the section of the web disposed between the pinching elements 22 and these output rollers 26. These rollers 26 are designed to allow some limited slippage as material exits intermittently from the pinching elements 22, but as material is paid out by the pinching elements 22, the slack is also taken up by the output rollers 26. Thus, the creased material is immediately and continuously output from the creasing system. Because the torque driven rollers 26 allow slowing or reversing of their rotation during the system's operation, formation of an initial bend to begin the creasing process is facilitated. This results since the input continues at normal speed while the output is blocked or slowed causing a buckle in the web.

The general positioning of the creasing rollers 22 and 24 are also detailed in FIG. 1. Therein, web 40 is shown pinched between the two upper rollers 22. Located above these rollers, relative to the figure, is a guideway 28. This guideway serves to contain the creased web sides as they are driven upward by the creasing rollers. Thus, the guide prevents the web from winding upon the rollers or otherwise becoming jammed in the moving elements of the system. The rollers themselves are spaced at a predetermined distance "d" 48. This distance is calculated on the basis of the type of web input to the system, such that, the spacing is wide enough to allow the web of a given thickness to pass unhindered and without potential damage to the printing or surface. However, the spacing is narrow enough to insure a positive grip by the rollers as they drive the web up and down the guideway 28. To accommodate general surface imperfections and other inconsistencies in thicknesses in the web, a spring may be included on one of the pinching rollers of each pair. This spring is characterized by a spring constant sufficient to insure smooth operation for normal surface variations in the web.

The guideway 28 serves an additional function beyond prevention of wrapping and jams. FIG. 1 also shows three photocells that are enabled at predetermined times to detect the presence of the creased web. The jam detector 42 is enabled to detect the web at various intervals in which a creased web should normally not appear at the given location. If, however, a jam is present, the web is detected in the location at the "wrong" time and the system will indicate a jam condition.

As the web advances further up the guideway on its normal pinching cycle, the web crosses the field of the slowing detector at 44. At this time, the system will signal the pinching rollers 22 to slow their advance in preparation for stopping.

Finally, when the web has reached its point of maximum input into the pinching element, it will encounter a reverse detector at 46. This detector will signal the pinching rollers to reverse direction, thus, biasing the web out of that pair of pinching rollers. The positioning of these slow and reverse detectors may be based upon, and made adjustable to attain, the desired distance between creases. This is possible because a longer distance traveled up the guideway translates into a longer distance between each crease, owing to the location of the next natural bend as described further below.

In order to insure maintenance of correct spacing between creases and to prevent potential jams, the preferred embodiment of this system includes a slack detector 50, that responds to excessive slack in the web material in the area between the pinching rollers 22 and the input rollers 20. This unit may operate by sensing, at predetermined intervals, the pressure asserted by a web of sufficient tautness. If the desired tautness is not present, the detector signals an adjustment in the input speed, or performs other action to indicate a lack of synchronization between pinching rollers and input rollers. A slack detector 50 may be positioned to contact each web face, operating in synchronization with the pinching roller pair currently in use (upper or lower in this embodiment).

Figure 2:
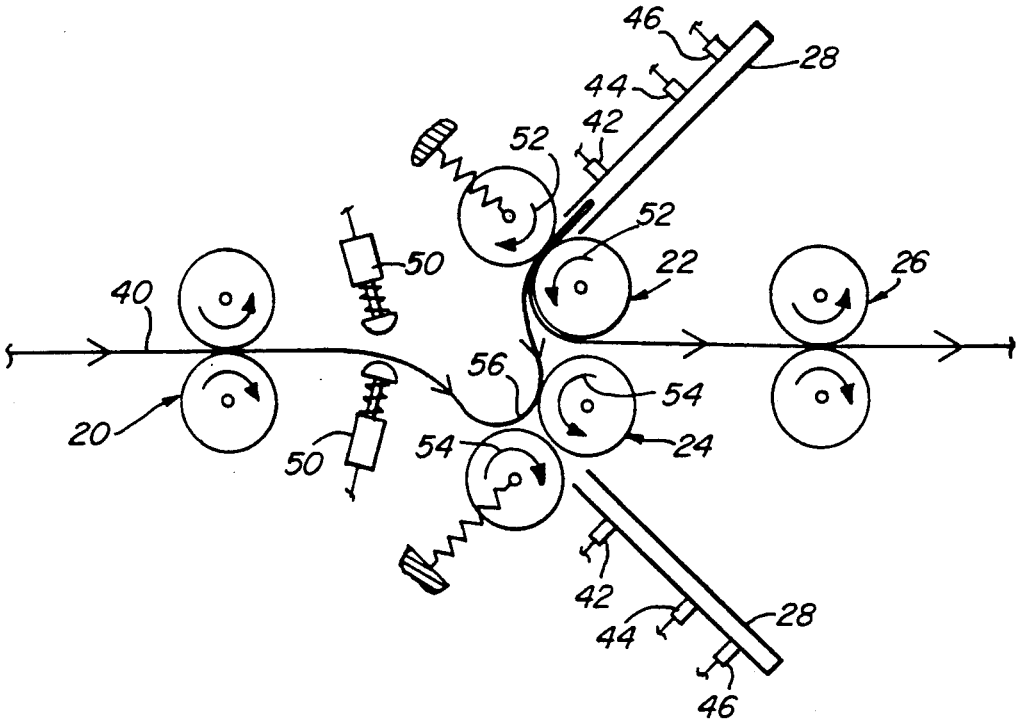
FIG. 2 is a schematic diagram of the general path of motion of a web between two pairs of pinching elements.
Figure 3A:
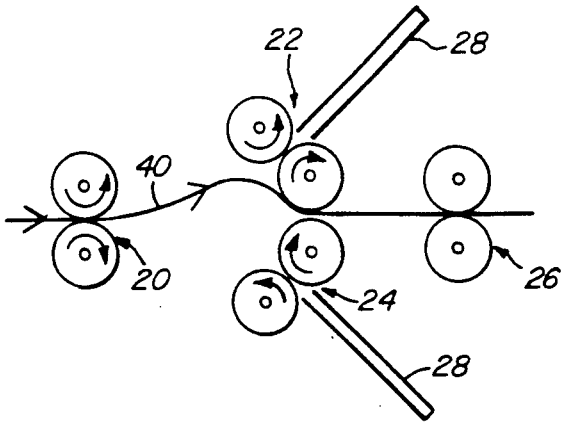
FIG. 3(*a–m*) is a schematic diagram of the web creasing process at various stages.
Figure 3B:
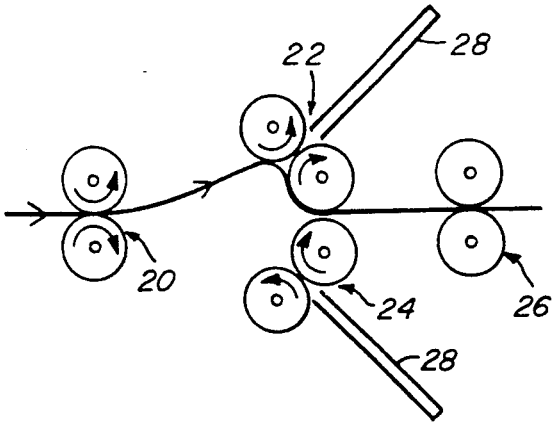
Figure 3C:
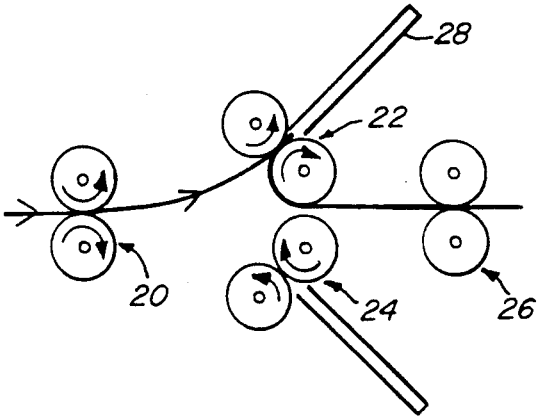
Figure 3D:
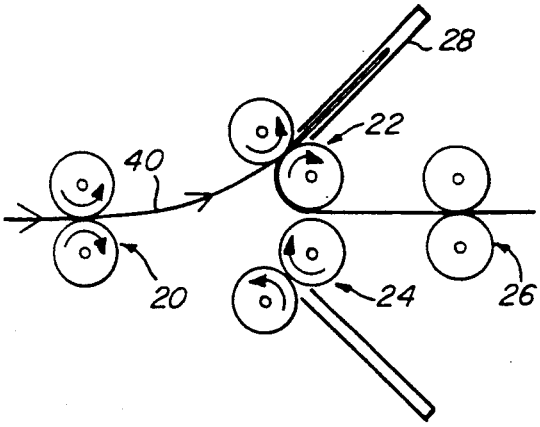
Figure 3E:
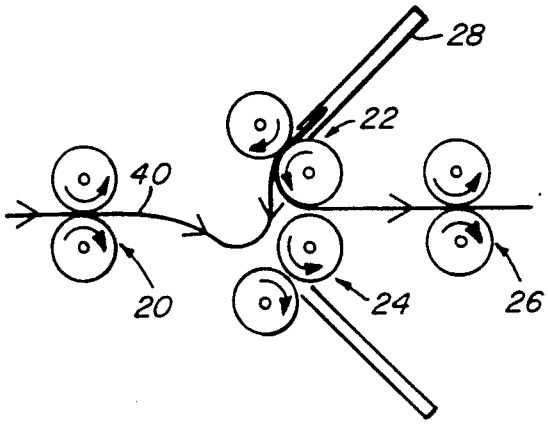
Figure 3F:
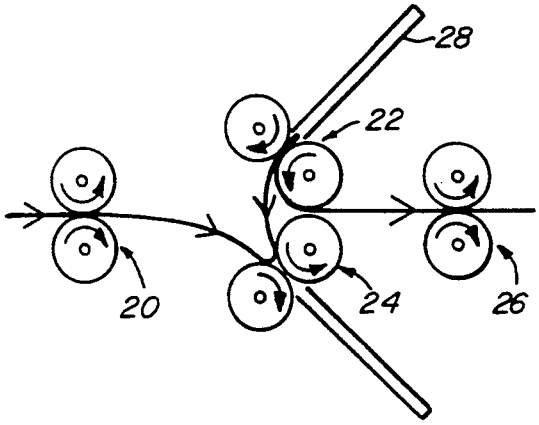
Figure 3G:
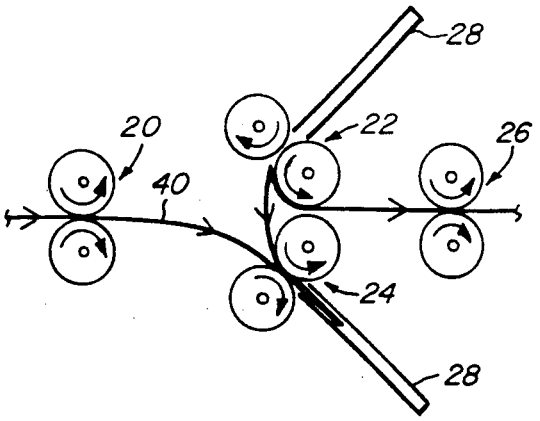
Figure 3H:
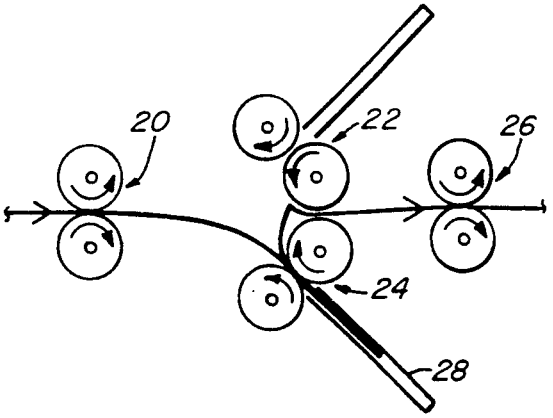
Figure 3I:
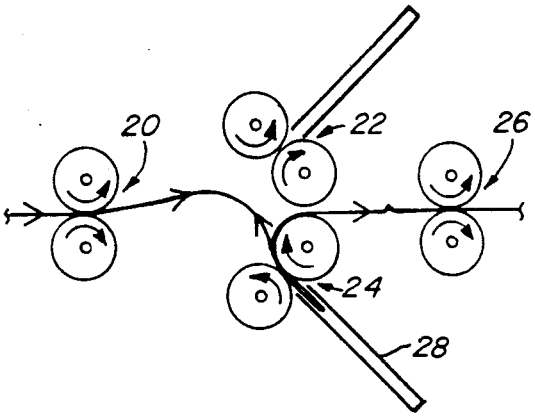
Figure 3J:
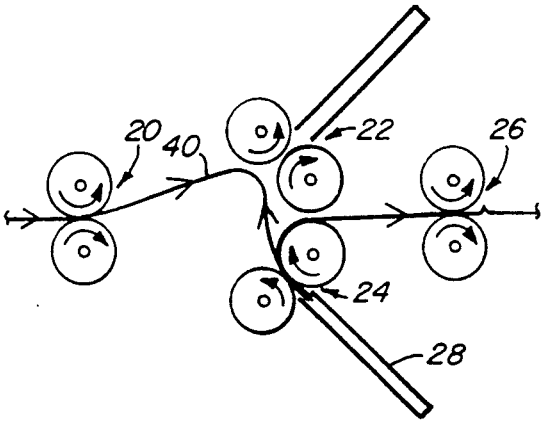
Figure 3K:
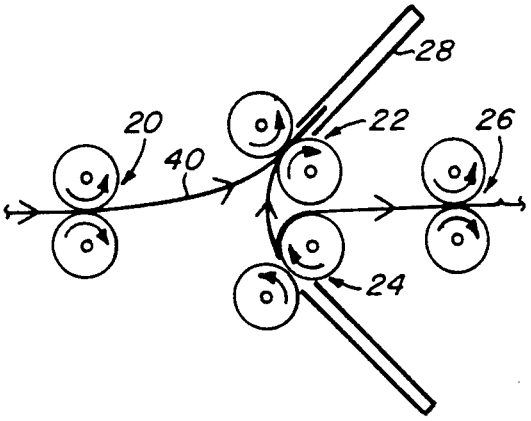
Figure 3L:
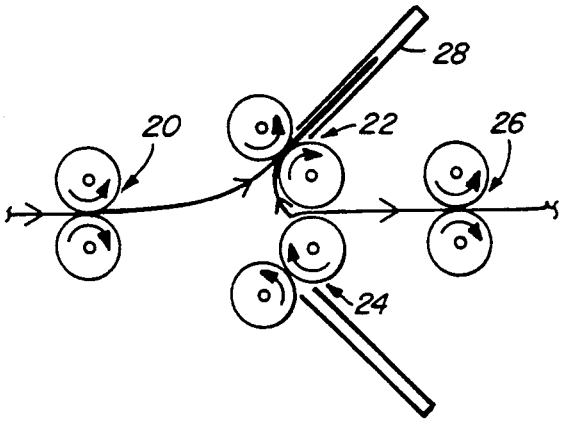
Figure 3M:
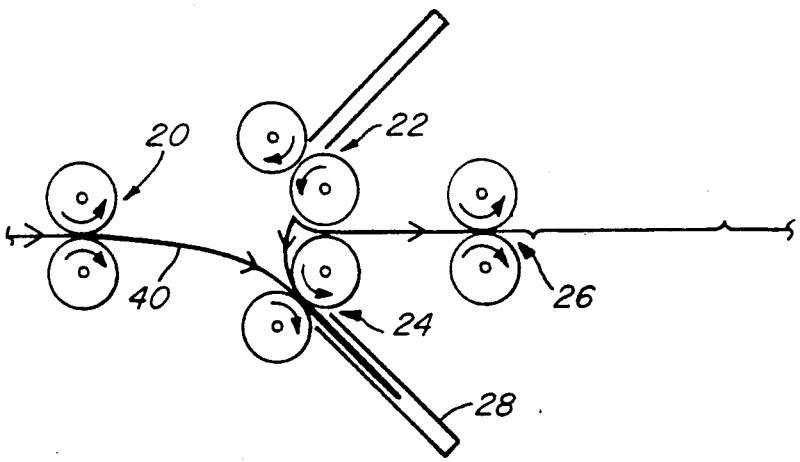

In the preferred embodiment, the upper and lower pair of pinching rollers may be coupled such that the driving of one pair of rollers in one direction results in a driving of the other pair of rollers in the opposite direction. This is illustrated in FIG. 2 by arrows 52 showing a direction of motion of the upper roller 22 and arrows 54 showing an opposite direction of motion for the lower rollers 24. In this figure, upper rollers 22 have driven the web 40 through its full creased distance and are no reversing direction to drive the creased web out from between the rollers. Simultaneously, as noted above, a natural bend 56 is forming in the web as a result of the forward bias of input rollers 20 and reversing action of the pinching rollers 22. This bend is directed toward the lower pair of pinching rollers 24 which are now rotating in a direction to drive the bend between themselves. Thus, the preferred embodiment offers the ability of continuously creasing a web upon alternating faces at spaced intervals which is suitable to the formation of a zig-zag folded stack or other zig-zag requirement. The section of web 40 exiting from the pinching rollers is directed toward the output rollers. As such, the output slack of the creased section is being removed.

The general cyclic process of folding from face to face upon the web is depicted in the various frames of FIG. 3(*a–m*). In a normal sequence, one of the pinching roller pairs is presented with a slight bend in the web material. If this bend is an initial one in the process, it may be created by slowing or reversing the output rollers to create a web buckle. Alternatively, the bend may be created by deflecting the otherwise straight path of the web as it moves into the creasing mechanism. In FIG. 3(*a*), a bend in the web is shown directed toward the upper pinching rollers 22. The rotation of the pinching rollers in combination with their high coefficient of friction causes the bend, as shown in FIG. 3(*b*), to be directed between the two rotating rollers. As this bend is caught by the frictional contact of the rollers, as shown in FIG. 3(*c*), the narrow spacing between these two rollers causes a sharp crease to form in the web. The continuing rotation of the rollers, shown in FIG. 3(*d*), then drives the two sides of the web, with a crease at their head, further between the rollers, up the guideway. At a predetermined point, the upper pinching rollers 22 reverse their direction of rotation, as shown in FIG. 3(*e*), and, thus, force the creased web out of the guideway and away from the roller pair. Simultaneously, the torque driven output rollers 26 remove any slack forming in the web section on the output side of the system. Similarly, input rollers 20 continue to feed more web material into the system causing a simultaneous bend to form in the direction of the lower pinching rollers 24. Note that at this point the ongoing operating of the system causes a bend to form in the web without need of any initialization process or slowing of the output rollers. These lower pinching rollers 24 rotate in the opposite direction from the now reversed upper pinching rollers 22. Thus, the lower rollers are ready to receive and force inward a bent web. As the upper pinching rollers complete their removal of a creased web, as shown in FIG. 3(*f*), the lower pinching rollers simultaneously catch and crease another section of web. The lower pinching rollers 24 continue to drive the next section of web into the lower guideway, as shown in FIG. 3(*g*), while the output rollers 26 continue to remove any additional slack. The lower pinching rollers 24 subsequently reverse operation, as shown in FIG. 3(*h*), when the appropriate length of web has been driven down the lower guideway. These lower rollers, upon reversal also, cause the upper rollers to again reverse to drive inward, as shown in FIG. 3(*i*). The driving out of the creased web by lower pinching rollers 24 in combination with the continued input of new web material by the input rollers 20 again causes a bend to form in proximity to the upper pinching rollers 22, as shown in FIG. 3(*j*). Note that the previous crease produced by the upper rollers in their previous cycle has already passed beyond the output rollers and is moving away from the system. The upper rollers 22, when presented with a bend, again catch and crease the bend between themselves, as shown in FIG. 3(*k*) and then force the creased web an appropriate distance up the guideway, as shown in FIG. 3(*l*). In this figure, a second crease, facing the opposite direction on the web, is also visible beyond the output rollers 26 depicting the ability of this embodiment to crease alternate faces of the web. In FIG. 3(*m*), finally, the crease of FIG. 3(*l*) exits the upper guideway and rollers 22 while a new crease is formed at the lower pinching rollers 24. As previously noted, this pattern is suitable for the stacking of zig-zag folds of material.

Having now described a limited number of embodiments of the present invention, it should now be apparent to those skilled in the art that numerous other embodiments and modifications thereof are contemplated as falling within the scope of the present invention as defined by the appended claims. For example, additional pinching rollers may be included and bends in the web material may be propagated such that various lengths and sequences of opposing faces may be folded.

What is claimed is:

1. A system for creasing a continuous web at predetermined locations comprising; means for biasing a continuous web in a first direction, first means for pinching a crease in said web disposed in a second direction, said first means for pinching including means for drawing a bend in said web into said first means for pinching and also including means for driving out said web with a crease from said first means for pinching, second means for pinching a crease in said web disposed in a third direction relative to the opposite face of said web from the face relative to said first means for pinching, said second means for pinching including second means for drawing a bend in said web into said second means for pinching and also including second means for driving out a creased web from said second means for pinching, said first means for drawing operating simultaneously with said second means for driving out and said second means for drawing operating simultaneously with said first means for driving out, the bend drawn into each of said first and second means for pinching being formed, respectively, by biasing of said web by each of said second and first means for driving out, and means for outputting a section of web with a crease from the system.

2. The system for creating of claim 1 wherein said first and said second means for pinching each include a corresponding pair of selectively rotatable roller means spaced in parallel at a predetermined distance.

3. The system for creasing of claim 2 wherein each of said first and second means for drawing include means for rotating the corresponding pair of selectively rotatable roller means to allow a bend in said web to be forcibly driven between said pair of selectively rotatable roller means.

4. The system for creasing of claim 2 wherein each of said first and second means for driving out include means for rotating a corresponding pair of selectively rotatable roller means to allow said creased web to be forcibly driven out from between said pair of selectively rotatable roller means.

5. The system for creasing of claim 2 wherein said roller means include frictional means on their surface to allow increased adhesion of said web to said surface.

6. The system for creasing of claim 1 wherein each of said first and second means for pinching includes guide means to direct said creased web as it moves through the means for pinching.

7. The system for creasing of claim 6 wherein said guide means comprises a pair of spaced plate means between which said creased web passes as it moves along said guide means.

8. The system for creasing of claim 6 wherein said guide means includes jam detection means, said jam detection means located at a point on said guide where, at a predetermined time, detecting the presence of said creased web would indicate a jam condition.

9. The system for creasing of claim 6 further comprising means for slowing the advance of said creased web further along said guide means, said means for slowing including slow detection means disposed on said guide means at a point where the further advance of said web is predetermined to be at a slower rate.

10. The system for creasing of claim 6 further comprising means for reversing the direction of movement of said creased web to allow said creased web to be driven out of said means for pinching, said means for reversing including reverse detection means disposed on said guide means at a point relative to the predetermined distance between creases on said web.

11. The system for creasing of claim 1 wherein said means for biasing includes a pair of selectively rotating input roller means between which said web is driven.

12. The system for creasing of claim 1 wherein said means for outputting includes a pair of selectively rotating output roller means between which said creased web is driven.

13. The system for creasing of claim 12 wherein said pair of output roller means include means for applying torque of a predetermined maximum amount with rotational slippage to remove slack from said creased web exiting said means for pinching and to prevent breakage of said creased web.

14. The system for creasing of claim 1 further comprising means for excessive slack detection positioned relative to said web between said means for biasing and said means for pinching.

15. The system for creasing of claim 1 wherein said web is a paper material.

16. A method for creasing a continuous web at predetermined locations comprising the steps of: biasing a continuous web in a first direction, a first pinching of a crease in said web to occur in a second direction, said first pinching including a first drawing of a bend in said web into the first pinching step and also including a first driving out of said web with a crease from the first pinching step, a second pinching of a crease in said web to occur in a third direction relative to the opposite face of said web from the face relative to the first pinching step; said step of second pinching including the step of second drawing of a bend in said web into the second pinching step and also including the step of a second driving out of a creased web from the second pinching step, said first drawing step operating simultaneously with said second driving out step and second driving step operating simultaneously with said first driving out step, formation of the bend that is drawn by first and second drawing steps into each of said first pinching step and said second pinching step being performed by, respectively, a biasing of the web by each of said second driving out step and said first driving out step, and means for outputting a section of web with a crease from the system.

17. The method for creasing of claim 16 wherein said first and said second pinching steps are accomplished with a corresponding pair of selectively rotatable rollers spaced in parallel at a predetermined distance.

18. The method for creasing of claim 17 wherein each of said first and said second drawing steps include the step of rotating the corresponding pair of selectively rotatable rollers to allow a bend in said web to be forcibly driven between said pair of selectively rotatable rollers.

19. The method for creasing of claim 17 wherein each of said first and second driving out steps include the step of rotating the corresponding pair of selectively rotatable rollers to allow said creased web to be forcibly driven out from between said pair of selectively rotatable rollers.

20. The method for creasing of claim 17 wherein said rollers each contain a frictional surface to cause adhesion of said web.

21. The method for creasing of claim 16 wherein each of said steps of first and second pinching includes a guiding step to direct said creased web as it moves during the pinching step.

22. The method for creasing of claim 21 wherein said guiding step is accomplished by a pair of spaced plate means between which said creased web passes during the guiding step.

23. The method for creasing of claim 21 wherein said guiding step includes a jam detection step, said jam detection occurring at a point in said guiding step in which the presence of said creased web would indicate a jam condition.

24. The method for creasing of claim 21 wherein said guiding step includes the step of slowing the advance of said creased web in said guiding step, said slowing step further comprising the step of slow detection occurring at a point in said guiding step in which the further advance of said web is predetermined to be at a slower rate.

25. The method for creasing of claim 21 wherein said guiding step includes the step of reversing the direction of movement of said creased web to allow said creased web to be driven out of the pinching step, said reversing step further comprising the step of reverse detection occurring at a point in said guiding step that is relative to the predetermined distance between creases on said web.

26. The method for creasing of claim 16 wherein said biasing step is accomplished with a pair of selectively rotating input rollers between which said web is driven.

27. The method for creasing of claim 16 wherein said outputting step is accomplished with a pair of selectively rotating output rollers between which said creased web is driven.

28. The method for creasing of claim 27 wherein said pair of output rollers include means for applying torque of a predetermined maximum amount with rotational slippage to remove slack from said creased web exiting said pinching step and to prevent breakage of said creased web.

29. The method for creasing of claim 16 further comprising the step of excessive slack detection relative to the area of said web moving between said biasing step and said pinching step.

30. The method for creasing of claim 16 wherein said web is a paper material.

* * * * *